United States Patent [19]

Mimitsuka et al.

[11] 4,037,130

[45] July 19, 1977

[54] GAS DISCHARGE DISPLAY DEVICE

[75] Inventors: Takao Mimitsuka; Tunekiyo Iwakawa, both of Tokyo, Japan

[73] Assignee: Nippon Electric Company Limited, Tokyo, Japan

[21] Appl. No.: 579,211

[22] Filed: May 20, 1975

[30] Foreign Application Priority Data

May 21, 1974 Japan ..... 49-56872

[51] Int. Cl.[2] ..... H01J 61/30

[52] U.S. Cl. ..... 313/220; 313/188

[58] Field of Search ..... 313/188, 201, 220, 217

[56] References Cited

U.S. PATENT DOCUMENTS 3,961,218 6/1976 Watanabe ..... 313/220

*Primary Examiner*—Palmer C. Demeo
*Assistant Examiner*—Darwin R. Hostetter
*Attorney, Agent, or Firm*—Hopgood, Calimafde, Kalil, Blaustein & Lieberman

[57] ABSTRACT

A gas discharge display device includes a center plate which comprises cells for defining a display area. The center plate, which is sandwiched between two electrode holding plates each of which has an electrode coated with a dielectric layer, is in the form of a porous insulating layer having a low dielectric constant.

5 Claims, 2 Drawing Figures

GAS DISCHARGE DISPLAY DEVICE

Figure 1:
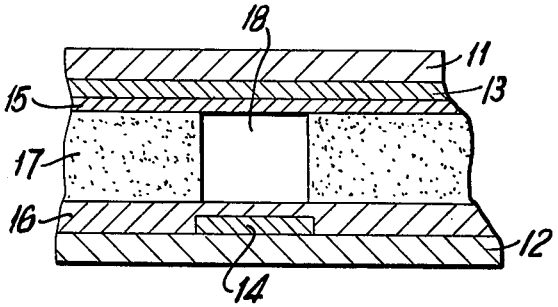

The present invention relates to gas discharge display devices capable of visually displaying letters, numerals, and the like by discharge in an ionizable gas.

One prior art gas discharge display device comprises a center plate having cells for defining a display area, and two electrode holding plates each having an electrode coated with a dielectric layer. The center plate is sandwiched between the two electrode holding plates, with the dielectric layers facing each other, thereby forming a discharge space. The center plate is in the form of a thin glass plate, usually 0.05 to 0.2 mm thick, and the cells are formed by etching or similar techniques. Another type of prior art gas discharge display device has no center plate. The display device that includes a center plate is advantageous over the type that does not include a center plate in that dot or segment cells glow in a distinct shape, offering a visually neat display. However, the center plate is thin and very fragile, requiring the entire device to be handled with extra care. Furthermore, the center plate must be processed by costly etching techniques, which increases the overall cost of the display device.

One solution to this problem is the use of screen print techniques for forming a glass plate 0.02 to 0.2 mm thick by printing low melting point glass frit on the dielectric layer, except at regions of dots or segments, and then baking the glass frit. The glass frit is usually of crystallizing type low melting point solder glass such as Corning's No. 7575, or the vitreous type.

In a gas discharge display device having cells formed with glass frit, the firing voltage is higher than in the type having no glass frit cells or center plate. In a practical gas discharge display panel having a center plate, the firing voltage is about 120 V, whereas, in the type having glass frit cells, the firing voltage may be as high as about 140 V. The firing voltage is higher in the latter device because the dielectric constant of glass frit is large; for example, it is about 20 in the crystallizing type glass frit, and about 16 in the vitreous type glass frit. Either dielectric constant is significantly higher than that ($\epsilon \approx 1$) of an ionizable gas (usually a rare gas or a mixture of rare gases). Hence, the dielectric flux density of an electric field applied to the two facing electrodes is reduced across the discharge gap, thereby causing the firing voltage to be raised.

It is, therefore, an object of the invention to provide a gas discharge display device offering a visually clear display without requiring a high firing voltage.

According to the present invention, there is provided a gas discharge display device comprising a center plate having cells for defining a display area, and two electrode holding plates each having an electrode coated with a dielectric layer, between which a center plate is sandwiched. The center plate is constituted of a porous insulating layer having a low dielectric constant. In one embodiment of the invention, the porous insulating layer consists essentially of a solder glass.

Figure 2:
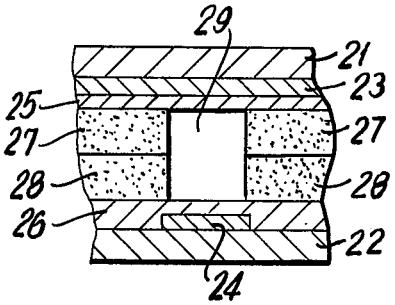

The other objects, features and advantages of this invention will be better understood from the following detailed description of preferred embodiments of the invention taken in conjunction with the accompanying drawing, wherein:

FIG. 1 is a cross-sectional view of a gas-discharge display device according to one embodiment of the invention, and FIG. 2 is a sectional view of another embodiment of the invention.

The matrix tape gas-discharge display panel of the present invention, as illustrated in FIG. 1, comprises electrode holding plates 11 and 12 made of transparent float glass or the like. Orthagonally related X- and Y-axis electrodes 13 and 14 are respectively formed on holding plates 11 and 12, and, dielectric layers 15 and 16 formed are on the surfaces of electrodes 13 and 14 respectively. A center plate in the form of an insulating layer 17 of high porosity comprising aluminum oxide powder is interposed between dielectric layers 15 and 16. The insulating layer 17, which is normally as thick as 0.05 to 0.2 mm, has a cell 18 for defining the display area.

According to the invention, the insulating layer 17 is porous and has a low dielectric constant. This insulating layer may be formed in many ways, for example:

EXAMPLE (1)

Aluminum oxide powder 6 μm in average grain size, low melting point solder glass, and black metal oxide are taken into a vehicle in weights of 85 g, 15 g and 5.5 g respectively, and stirred thoroughly, whereby an aluminum oxide paste is obtained. The paste is sheeted to a thickness of 0.15 mm by screen print techniques and baked at a temperature of about 520° C for 20 minutes, to form an aluminum oxide insulating layer. This insulating layer has a very high porosity and an equivalent dielectric constant of about 3.

The low melting point solder glass serves as a binder between aluminum oxide powder particles and between aluminum oxide powder particles and dielectric layer 15 (16) on electrode holding plate 11 (12), thus securing the insulating layer 17 to the electrode holding plate 11 (12) when the baking process is over.

The firing voltage across the cell of the display panel employing the insulating layer formed according to this method is about 105 V, which is much lower than in the prior art display panel comprising cells formed with glass frit.

EXAMPLE (2)

Sixty grams of aluminum oxide powder 6 μm in average grain size and 25 g of aluminum oxide powder 0.5 μm in average grain size are mixed together. Then 15 g of low melting point solder glass and 5.5 g of black metal oxide are added to the mixture of aluminum oxide powder and stirred in a vehicle. The resultant paste is printed and baked in the same manner as in Example (1) above.

The printability is better in Example (2) than in Example (1); however, the firing voltage in a display device employing an insulating layer made according to Example (2) is about 110 V, which is slightly higher than that obtained in a device including an insulating layer made according to Example in (1).

In Examples (1) and (2), the strength of the insulating layer formed increases with an increase in the amount of low melting point solder glass relative to the amount of aluminum oxide powder. However, the use of too much low melting point solder glass relative to the aluminum oxide powder will result in a higher firing voltage because the dielectric constant of low melting point solder glass is as high as 16. Hence, the ratio of the constituents of the insulating layer must suitably be determined, as described in Examples (1) and (2), to assure an insulating layer 17 that exhibits optimum characteristics with respect to strength and firing voltage.

In both Examples (1) and (2), crystallizing type glass frit may be used to serve as a binder. This glass frit has a higher dielectric constant than the vitreous type and hence will cause a higher firing voltage.

The purpose of the black metal oxide is to enhance the contrast of glow in a cell or segment against the background. In this example, 15% contrast is obtained against MgO standard white surface. The desired contrast can be obtained by adjusting the amount of black metal oxide contained in the aluminum paste. This contrast can also be varied according to the heat applied when the printed aluminum oxide paste is baked and to the time for which heat is applied. Generally, the higher the temperature of the heat applied and the longer the time for which the heat is applied, the darker will become the insulating layer. For example, a contrast of about 5% is obtained when the aluminum oxide paste is baked at a temperature of 535° C for 30 minutes.

In the discharge display device of this embodiment, the firing voltage is markedly lower than in the prior art display device having a center plate or cells formed with glass frit.

According to this embodiment, the cell is formed by means of screen print in which the thickness of the insulating layer can easily be determined in the range of 0.02 to 0.2 mm by adjusting the thickness of a the screen emulsion used and the viscosity of the aluminum oxide paste.

In the embodiment of the invention illustrated in FIG. 2, the display device comprises electrode holding plates 21 and 22, X- and Y-axis electrodes 23 and 24, dielectric layers 25 and 26, and aluminum oxide insulating layers 27 and 28 formed on the dielectric layers 25 and 26 respectively. The insulating layers 27 and 28 are constituted of a high porosity material having a low dielectric constant, as in the first embodiment. The sum of the thicknesses of the two insulating layers 27 and 28 may advantageously be 0.15 mm. For example, the thickness of the insulating layer 27 may be made 0.02 mm and that of the insulating layer 28 may be made 0.13 mm. The sum of the thicknesses of the two layers, i.e., the discharge gap, can arbitrarily be determined in the range of 0.05 to 0.2 mm, depending on operating conditions.

It will be appreciated from the foregoing that the gas discharge display device of the invention brings about many advantages, among which are:

1. The firing voltage is low because of the materials used.

2. The display device can be manufactured at low costs and handled with ease because of the adoption of a screen print process to fabricate the center insulating layer.

3. Each of the dots or segments which build up a display area glows sharply because the screen print process used to fabricate the insulating layer enables the dots or segments to be shaped with high accuracy.

Furthermore, because the porosity of the insulating layer is high, the insulating layer has a getter effect on a impurity gas against the gas enclosed in the cells of the display panel. The result of analysis by a mass analyzer indicates that the insulating layer has a substantial getter effect on the impurity gas, although not so high as with a barium getter.

In the embodiments of the invention herein specifically described, aluminum oxide powder was used in the insulating layer. According to the invention, other kinds of powder such as MgO powder, having a low dielectric constant, may be used instead of aluminum oxide powder. Also the compound ratio of element materials such as aluminum oxide powder, solder glass and metal oxide may arbitrarily be determined to meet the purpose of the invention.

It will thus be understood that modifications may be made to the embodiments herein specifically described, all without necessarily departing from the spirit and scope of the invention.

What is claimed is:

1. A gas discharge display device comprising:

a pair of insulating plates spaced from each other in substantially parallel relation, each of said plates having an inside surface facing that of the other plate and at least one of said plates being transparent;

a first group of at least one electrode disposed on the inside surface of one of said insulating plates, a second group of at least one electrode disposed on the inside surface of the other of said insulating plates, said first and second groups of electrodes being disposed traverse to each other to form a uniform discharge gap;

a first dielectric layer covering said first group of electrodes and a second dielectric layer covering said second group of electrodes;

a thin flat member disposed between said insulating plates to give said substantially parallel relation therebetween, said member being made entirely of a porous dielectric material and having an aperture of a shape substantially identical to said discharge gap; and an ionizable gas filling said discharge gap.

2. A gas discharge display device as claimed in claim 1, wherein said porous material contains a mixture of powdered metal oxide and low melting point glass.

3. A gas discharge display device as claimed in claim 2, wherein said material further contains a black metal oxide.

4. A gas discharge display device as claimed in claim 1, wherein said thin flat member is formed through the screen printing of said porous material on at least one of said dielectric layers.

5. A gas discharge display device as claimed in claim 2, in which said powered metal oxide is one of aluminum oxide and manganese oxide.

* * * * *